US005617754A

United States Patent [19]

Senft et al.

[11] Patent Number: 5,617,754

[45] Date of Patent: Apr. 8, 1997

[54] SINGLE STAGE TWO PLANE COILED REINFORCING BAR STOCK STRAIGHTENER

[75] Inventors: Frank Senft, Fairfield Glade, Tenn.; Joel D. McCorkel, York, Pa.

[73] Assignee: Kenneth A. Kauffman, York, Pa.

[21] Appl. No.: 576,121

[22] Filed: Dec. 21, 1995

[51] Int. Cl.[6] ..... B21D 3/02

[52] U.S. Cl. ..... 72/165; 72/226; 72/247

[58] Field of Search ..... 72/164, 165, 307, 72/226, 247

[56] References Cited

U.S. PATENT DOCUMENTS

| | | | |
|---|---|---|---|
| 1,914,975 | 6/1933 | Nlgro | 72/164 |
| 2,693,219 | 11/1954 | Heller | 72/164 |
| 3,719,067 | 3/1973 | Skawden | 72/164 |
| 3,777,531 | 12/1973 | McClain | 72/226 |
| 3,823,749 | 7/1974 | Ritter | 72/307 |
| 3,916,662 | 11/1975 | Arnold | 72/132 |
| 4,048,825 | 9/1977 | Dastrup et al. | 72/129 |
| 4,719,781 | 1/1988 | Cloup | 72/164 |
| 4,782,684 | 11/1988 | Benton | 72/307 |
| 4,949,567 | 8/1990 | Corbin | 72/164 |
| 5,067,337 | 11/1991 | Del Fabro | 72/164 |
| 5,345,804 | 9/1994 | Carrere | 72/164 |

FOREIGN PATENT DOCUMENTS

| | | | |
|---|---|---|---|
| 2115151 | 7/1972 | France | 72/164 |
| 507029 | 6/1945 | United Kingdom | 72/164 |
| 693511 | 7/1953 | United Kingdom | 72/165 |
| 1041849 | 9/1966 | United Kingdom | 72/164 |

*Primary Examiner*—Daniel C. Crane
*Attorney, Agent, or Firm*—Samuel M. Learned, Jr.

[57] ABSTRACT

A single stage two plane coiled reinforcing bar stock straightener adapted to straighten an infeed of coiled reinforcing bar in both the horizontal and vertical planes for providing the straightened delivery of coil fed reinforcing bar material to processing and converting machinery.

11 Claims, 12 Drawing Sheets

SINGLE STAGE TWO PLANE COILED REINFORCING BAR STOCK STRAIGHTENER

BACKGROUND OF THE INVENTION

Steel rod material of that type typically employed in the reinforcing of cast concrete structures, commonly referred to as "re-bar", is formed into various reinforcing shapes and profiles by bending machines from an infeed of either straight rod re-bar of standard 40 or 60-foot lengths, or re-bar material fed from a coil.

In the case of coil fed re-bar material delivery it is first necessary to remove the coil bend set as the re-bar is stripped and fed from the unwinding coil so as to deliver a straightened material to the bending machine for processing. Typically the apparatus employed for straightening and cutting of coil fed re-bar material incorporates two separate banks or stages of rollers set to operate perpendicularly upon the ribbon of re-bar material fed therethrough from the coil. One set of rollers are adjustable to correct and straighten coil bend set curvature in the horizontal plane, and the other set of rollers are adjustable to correct and straighten coil bend set curvature in the vertical plane. Exemplary coil re-bar straightening machines operable on the foregoing principal and profile are those as are respectively taught in U.S. Pat. No. 3,916,662 to Arnold dated Nov. 4, 1975, and U.S. Pat. No. 4,048,825 to Dastrup et al dated Sep. 20, 1977.

Other and mechanically more complex apparatus that operate to straighten coil fed re-bar, with articulated on the fly lever adjustment features to compensate and correct for dimensional variations of the infeed product to be straightened, are exemplified by the respective teachings of Cloup in U.S. Pat. No. 4,719,781 dated Jan. 19, 1988, and U.S. Pat. No. 5,345,804 to Carrare dated Sep. 13, 1994.

Lastly, the teaching of Corbin in U.S. Pat. No. 4,949,567 dated Aug. 21, 1990, shows a two stage two plane apparatus and method for straightening wire by employing a bank of horizontally adjustable rollers to correct the cast characteristic, and a vertically adjustable roller to correct the helix characteristic.

The applicant herein, by his invention teaches an apparatus and method which provides both new and novel approaches to effect the simple and efficient straightening of coiled reinforcing bar material for delivery to processing and converting machinery.

SUMMARY OF THE INVENTION

It is the principal object of the present invention to provide a single stage two plane coiled reinforcing bar stock straightener for delivery of straightened coil fed reinforcing bar material to processing and converting machinery such as, for example, a stirrup bender and the like.

It is another object of the present invention to provide a single stage two plane coiled reinforcing bar stock straightener that is adapted for retrofit installation assembly upon a typical straight rod stock processing machine of that type employed for the shearing and bending of concrete reinforcing bar.

It is also an object of the present invention to provide a pivotally displaceable single stage two plane coiled reinforcing bar stock straightener that is adapted to be arcuately removed from the infeed position of a typical straight rod stock processing machine to thereby enable change over to conventional infeed of straight rod stock reinforcing bar material in the currently standard 40 and 60-foot lengths.

It is a further object of the present invention to provide an alternate embodiment dual feed single stage two plane coiled reinforcing bar stock straightener that is adapted for both fixed and pivotal installation assembly upon a two-up straight rod stock processing machine.

It is also an object of the present invention to provide single stage two plane coiled reinforcing bar stock straighteners in both the single and dual feed versions which provide efficient coiled infeed reinforcing bar material straightening in a shorter distance, with mechanically simpler means, and with less energy requirements.

It is still another object of the present invention to provide both single and dual feed single stage two plane coiled reinforcing bar stock straighteners that substantially reduce setup times and production labor requirements as well as material waste during running.

Even yet another object of the present invention is to provide both single and dual feed single stage two plane coiled reinforcing bar stock straighteners that are of durable construction and easily operated by persons of ordinary skill.

The foregoing, and other objects hereof, will be readily evident upon a study of the following specification and accompanying drawings comprising a part thereof.

DETAILED DESCRIPTION OF THE INVENTION

Figure 1:
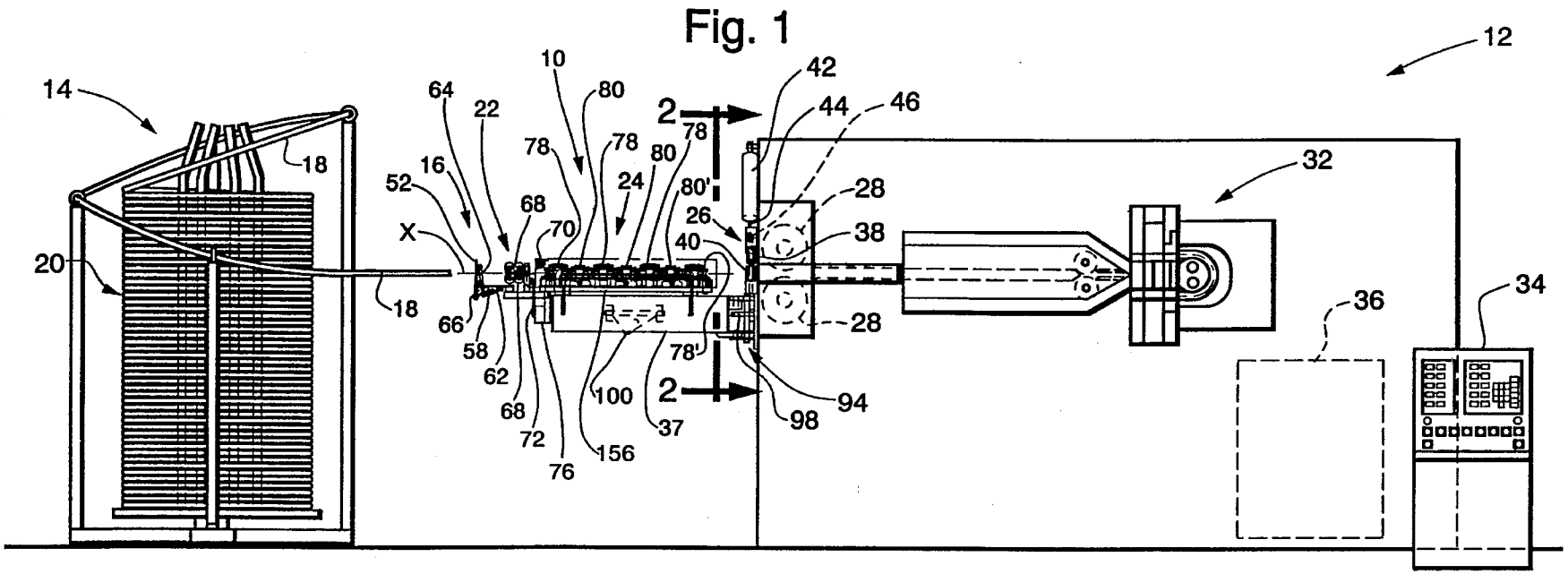
FIG. 1 is a side elevation view of the preferred embodiment single stage two plane coiled reinforcing bar stock straightener shown pivotally mounted in coiled re-bar infeed operational retrofit assembly to a typical straight rod stock processing machine of that type employed for the shearing and bending of concrete reinforcing bar.

Referring to FIG. 1, the single stage two plane coiled reinforcing bar stock straightener 10 of present invention and the major component parts thereof comprising the same are shown in an exemplary retrofit installation upon a typical stirrup bending machine 12 which is provided to receive infeed from a re-bar coil feed station 14, wherein the major component parts of said straightener are the coil feed jam and safety switch assembly 16 through which re-bar coil stock 18 being stripped for infeed delivery from the re-bar coil 20 is passed to and through the re-bar coil stock guide roll assembly 22 and into the single stage two plane straightening roll station 24 and thereafter into the straightened re-bar coil stock infeed compressive guide roll assembly 26 for delivery to the machine loader compression drive wheels 28 which both pull the re-bar coil stock from the re-bar coil 20 and impart forwarding drive to the straightened re-bar coil stock 30 for infeed to the shearing and bending module 32 of said machine 12 as operationally programmed through the machine and stirrup bending module controller 34 and driven by the machine motor 36.

Referring again to FIG. 1 to explain in greater detail the novel features of the present invention 10, which is adapted by means of the pivotal mounting base 37 thereof and the straightened re-bar coil stock infeed compressive guide roll assembly 26 to be engaged and operational for re-bar coil stock 18 infeed, or alternately disengaged and pivotally offset for straight re-bar rod infeed. Thus, depending upon run-length, set-up, material cost factors, and other production and economic variables the straightener 10 hereof, and the alternate embodiment versions thereof, as will hereinafter be more fully detailed and described, provide the flexibility for enabling selective optimum operational utilization of said machine 12.

Presuming the machine 12 is to be operational for receiving and processing re-bar from a re-bar coil 20 infeed utilizing the straightener 10 as shown in FIG. 1. In the foregoing re-bar processing mode, the re-bar coil stock 18 is infed stripped from the re-bar coil 20 through engagement of the straightened re-bar coil stock 30, after passage through the straightener 10, by the machine loader compressive drive wheels 28. The re-bar coil stock material is stabilized and controlled during the infeed transit thereof through the single stage two plane straightening roll station 24 by compressive engagement of the infeed re-bar coil stock 18 by the re-bar coil stock guide roll assembly 22 at the straightening roll station 24 infeed end, and at the delivery end thereof the straightened re-bar coil stock 30 is engaged and infed guided to the machine loader compressive drive wheels 28 by the compressive guide roll assembly 26 as shown in greater detail in FIGS. 2A and 2B. In the event of a re-bar coil stock 18 infeed misalignment or jam during the above described transit thereof through the straightening roll station 24, the coil feed jam and safety switch assembly 16 is tripped and the machine 12 is shut down.

Figure 2B:
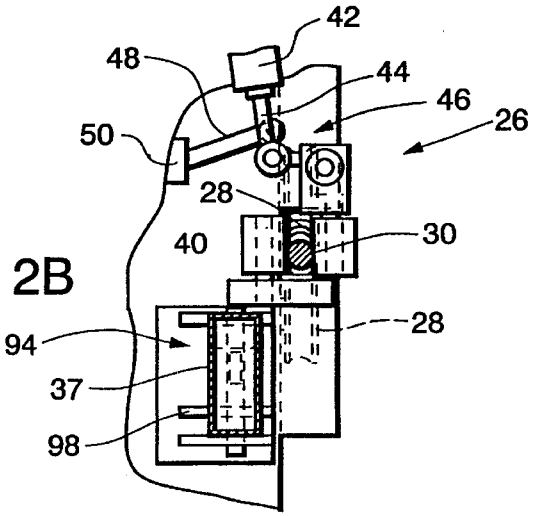
FIG. 2B is a view similar to that as shown in FIG. 2A, illustrating, however, the straightened coil stock infeed guide rolls in operative engagement position.
Figure 2A:
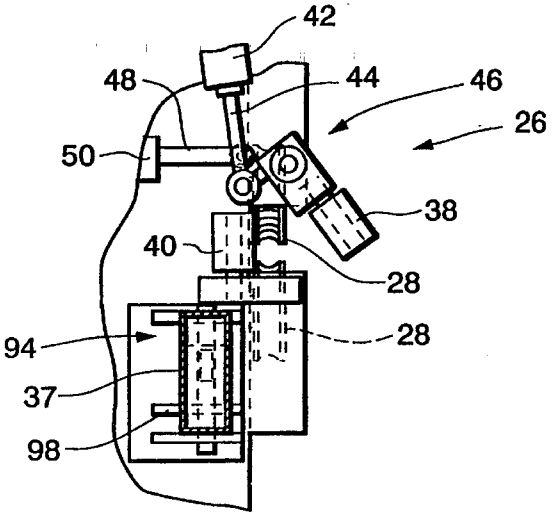
FIG. 2A is an enlarged fragmentary end elevation view of the straightened coil stock infeed guide rolls illustrated in non-engagement position, as shown in FIG. 1 and seen along the line 2—2 thereof.

Referring now to FIGS. 2A and 2B, wherein the compressive guide roll assembly 26 is first shown in the inoperative position with the compression roller 38 pivotally disengaged from a compressive straightened re-bar coil stock engagement to the anvil roller 40. The foregoing disengaged roller profile is utilized for make-ready loading of re-bar coil stock 18 in preparation for straightened coil stock 30 infeed to said machine 12, and is accomplished by activating the compression guide roll assembly cylinder 42 from the module controller 34 to thereby extend the piston rod 44 and also thereby pivotally deflect the compression roller 38 outwardly about the pivot pintle linkage 46 and from compressive engagement to allow for make-ready infeed of straightened re-bar coil stock 30 to the machine loader compressive drive wheels 28. It will also be noted that when the compressive guide roll assembly 26 is profiled to the inoperative position as shown in FIG. 2A, the safety switch contact arm 48 is positioned to cut power to said machine 12 by means of the compressive guide roll assembly safety switch 50, so that during make-ready loading of straightened re-bar coil stock 30 to the machine loader compressive drive wheels 28 said machine 12 can not operate. Once, however, the straightened re-bar coil stock 30 is loaded to infeed engagement with the machine loader compressive drive wheels 28, as illustrated in FIG. 2B, the cylinder 42 is de-energized and the piston rod 44 retracted to both rotate the compression roller 38 into compressive guiding contact with the straightened re-bar coil stock to anvil roller 40 for infeed guiding, and move the safety switch contact arm 48 to the safety switch 50 off position and thereby enable re-powering of said machine 12 for operational processing of straightened re-bar coil stock 30.

Figure 3:
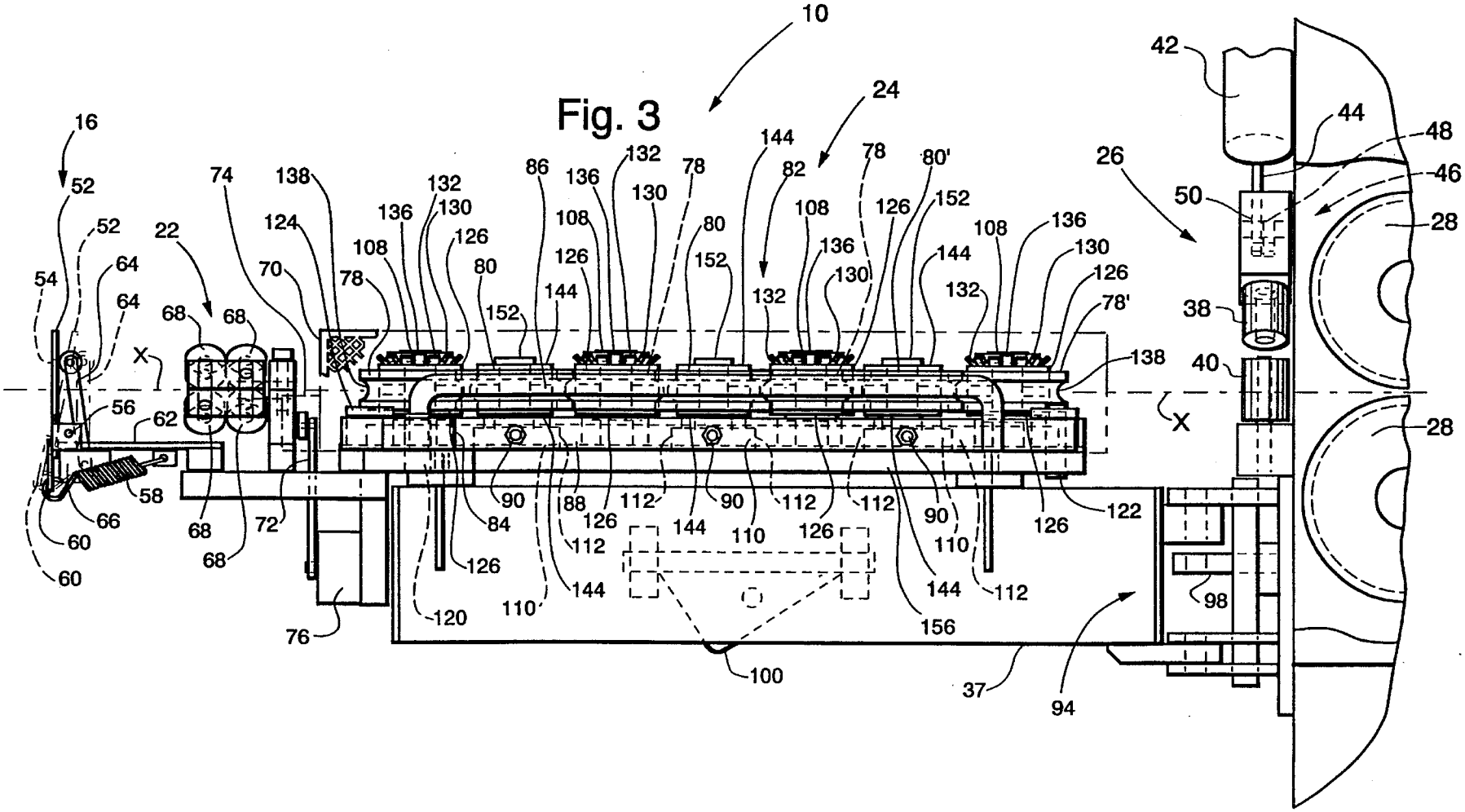
FIG. 3 is an enlarged side elevation of the preferred embodiment single stage two plane coiled reinforcing bar stock straightener as shown in FIG. 1.

Turning now to a consideration of the enlarged side elevation view of the preferred embodiment single stage two plane coiled reinforcing bar stock straightener 10 as shown in FIG. 3. Infeed of re-bar coil stock 18 to and through said straightener 10 and on to the machine loader compressive drive wheels 28 is along the re-bar coil stock infeed axis "X", with infeed entry of coil stock 18 first through the switch plate 52 switch plate opening 54 of the coil feed jam and safety switch assembly 16. It will be noted that the switch plate 52 is pivotal about the switch plate pintles 56 against the resilient force of the switch plate coil spring 58, and is normally held in an upright vertical position as shown in solid line rendition in FIG. 3 by said spring 58 pivotally about said pintles 56 against the switch plate stop 60 mounted to the coil feed jam and safety switch assembly base 62. In this normally upright vertical position of the switch plate 52 the opening 54 thereof allows unimpeded and aligned infeed passage therethrough of the re-bar coil stock 18 along the infeed axis "X". If, however, there is operational infeed misalignment of the re-bar coil stock 18 on entry through the switch plate opening 54, the switch plate 52 is contacted thereby and forced pivotally back about the switch plate pintles 56 against the yielding force of coil spring 58 and contactably against the coil feed jam and safety switch contact arm 64 to pivotally deflect the same as shown in phantom in FIG. 3, and thereby activate the coil feed jam and safety switch 66 to shut down the machine 12 and also thereby cut power to the machine loader compressive drive wheels 28 thus to prevent further misaligned re-bar coil stock infeed or damage to the straightener 10. Also, if a worker's hand is inadvertently caught and pulled forward into contact with the switch plate 52 by the infeeding re-bar coil stock 18, the coil feed jam and safety switch is similarly activated in a manner as above described and power to machine 12 and the machine loader compressive drive wheels 28 is cut thus to prevent worker injury.

Continued forwarding infeed of re-bar coil stock 18 along the infeed axis "X" is to the re-bar coil stock guide roll assembly 22, being comprised of two sets of compressive guide rollers 68 which contactably engage and roll-guide pass the infeeding re-bar coil stock 18 to the single stage two plane straightening roll station 24. It will be noted that the straightening roll station 24 is protectively enclosed within a safety guard cover 70 which may be pivotally displaced for purposes of make-ready access to the straightening rolls. When the safety guard cover 70 is in operable protective position as shown, the safety guard cover switch tripper 72 is engaged by the safety guard cover switch tripper tab 74 and being thus tripped energizes the safety guard cover switch 76 thereby powering machine 12. Thus, when the safety guard cover 70 is pivotally retracted to enable straightening roll station 24 worker access for maintenance or make-ready purposes and the like, the machine 12 can not be turned on and thereby cause accidental activation thereof to the hazard of operational personnel working in and around the straightening roll station 24.

The single stage two plane straightening roll station 24 is comprised of a plurality of cooperatively interactive vertically adjustable re-bar coil stock straightening rollers 78 for effecting vertical straightening of re-bar coil stock 18 infeed, and a complementary plurality of cooperatively interactive horizontally adjustable re-bar coil stock straightening rollers 80 for simultaneous effecting the horizontal straightening of re-bar coil stock 18 infeed. Adjustment of the vertically and horizontally adjustable straightening rollers 78 and 80 will be explained in detail upon consideration of subsequent figures hereinafter, however, also shown in FIG. 3 are the cam operable horizontally adjustable straightening roller opener 82 comprised of a cam 84 which is moveable from a closed lock to open position by means of the cam bar 86, and the horizontal roll adjustment bolt plate 88 with a corresponding plurality of horizontal straightening roller adjustment bolts 90 one each respectively for said horizontally adjustable straightening rollers 80.

Figure 4:
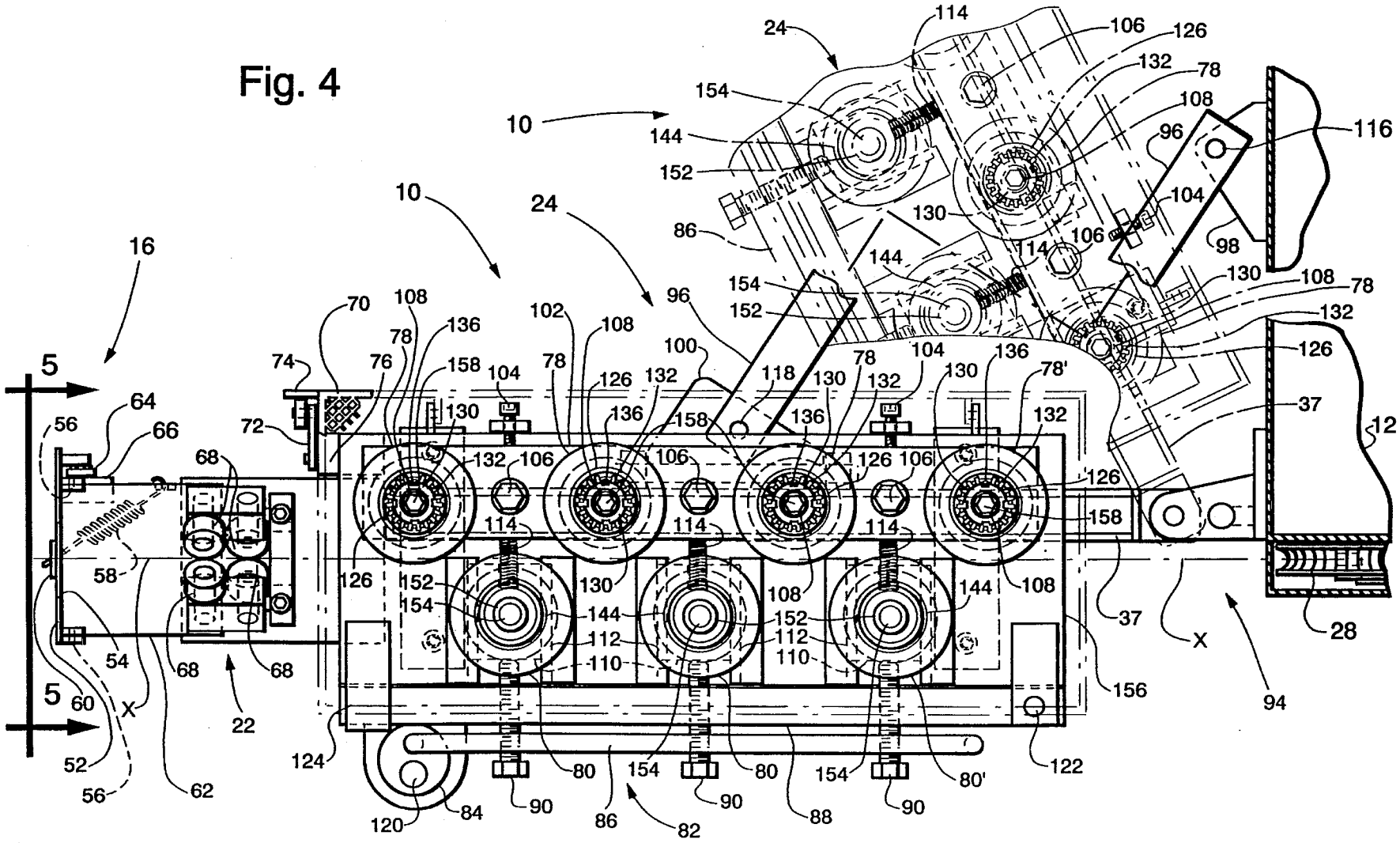
FIG. 4 is a top plan view of the preferred embodiment single stage two plane coiled reinforcing bar stock straightener as shown in FIG. 3, with the pivotally deflected position thereof to accommodate straight re-bar infeed shown in phantom line rendition.

The straightening roll station pivotal mounting base 37 is likewise shown in FIG. 3, which operates by means of the pivot assembly 94, as more clearly illustrated in FIG. 4, to accommodate the pivotal offset thereof and thereby enable straight re-bar infeed to the machine 12, the details of which will be more specifically described on a consideration of FIG. 4.

Turning now to FIG. 4, which is a top plan view of the straightener 10 as shown in FIG. 3, with, however, the pivotally deflected position thereof additionally being shown in phantom line rendition whereby the machine loader compressive drive wheels 28 are thereby made directly accessable to accommodate straight re-bar stock infeed to said machine 12. Also illustrated are additional structural and functional features of said straightener 10, which enable the foregoing straight re-bar stock infeed capability as well as adjustment capabilities, among which are the detachable stabilizing strut 96 which detachably connects from the machine strut connector 98 to the straightener strut connector 100 to thereby provide stabilized alignment of the straightener 10 with the machine loader compressive drive wheels 28 during re-bar coil stock 18 infeed and straightening operations as shown in solid line rendition, and the pivotally deflected position of the straightener 10 as aforesaid in order to accommodate straight re-bar stock infeed to said machine 12, which is accomplished by manual detachment and removal of the stabilizing strut 96 thereby enabling pivotal deflection of the straightener 10 as shown in phantom line rendition.

When the machine 12 is adapted for re-bar coil stock 18 infeed and straightening operations, the re-bar coil stock infeed axis "X" is adjusted during make-ready set-up to center infeed of the particular coil stock diameter being fed to horizontally center on the machine loader compressive drive wheels 28. The foregoing adjustment is accomplished by means of the vertically adjustable straightening rollers 78, which in turn are connected to and laterally adjustable by means of the infeed axis horizontal adjustment bar 102 which is deflected in horizontal infeed axis "X" adjustment by operation of the adjustment bolts 104 and set in deflected horizontal infeed axis "X" adjustment by the horizontal adjustment bar set bolts 106 whereby infeed transit of the re-bar coil stock 18 is brought into infeed axis "X" horizontal alignment from entry to the switch plate opening 54 of said straightener 10 through and to the machine loader compressive drive wheels 28. Vertical adjustment of the straightened re-bar coil stock 18 on exit from the straightening roll station 24 to coincidence with the vertical plane of the infeed axis "X" for vertically aligned delivery to the machine loader compressive drive wheels 28 is by means of the inboard vertically adjustable straightening roller 78' moved vertically up or down, as are all such rollers 78, each by the respective vertically adjustable allen bolt 108 as will hereinafter be more fully described. Suffice it to say at this point, however, that vertical straightening per se of the re-bar coil stock 18 infeed is accomplished by vertical sets of the outboard plurality of vertically adjustable straightening rollers 78, and vertical plane infeed guiding of the straightened re-bar coil stock 18 to the machine loader compressive drive wheels 28 coincidental with the infeed axis "X" is accomplished by the inboard vertically adjustable straightening roller 78'.

Considering now the structural and functional features of the horizontally adjustable straightening rollers 80 as shown in FIG. 4. The rollers 80 are respectively mounted to slide blocks 110 which are slidably retained and adjustably move horizontally within the slide block tracks 112 in horizontal adjustment against the slide block compression spring 114 as set by the horizontal straightening roll adjustment bolts 90. During initial make-ready operations, in order to facilitate and provide better worker access to the straightening roll station 24 infeed axis "X" area for accomplishing make-ready adjustments and sets, the plurality of horizontally adjustable straightening rollers 80 are opened by means of the cam operable horizontally adjustable straightening roller opener 82 in the manner to be hereinafter more fully described. Suffice it to say at this point, however, that horizontal straightening per se of the re-bar coil stock infeed is accomplished by horizontal sets of the outboard plurality of horizontally adjustable straightening rollers 80, and horizontal plane guiding of the straightened re-bar coil stock 18 to the machine loader compressive drive wheels 28 coincidental with the infeed axis "X" is accomplished by the inboard horizontally adjustable straightening roller 80'.

Again, the purpose and function of providing a pivotal deflection capability for the straightener 10 is to facilitate infeed loading of straight re-bar stock in the standard 40-to-60 foot lengths, which does not need straightening and may be directly infed to said machine 12 by means of the machine loader compressive drive wheels 28. This optional capability for choice in feeding either re-bar coil stock 18 or straight re-bar stock, therefore, enables the use advantage of optimum economic and operational run conditions based upon the best balance of cost of stock, run length, set up and other such determinative considerations and factors. And, the mechanical simplicity and facility by which a conversion may be made from use to non-use of the straightener 10 by the simple expedient of pivotal positioning thereof and engaging or alternately disengaging the detachable stabilizing strut 96 by means of the machine strut connector pintle 116 and the straightener strut connector pintle 118, there is thereby realized a substantial enhancement and extension of the functional latitude of a typical stirrup bending machine 12.

Figure 5:
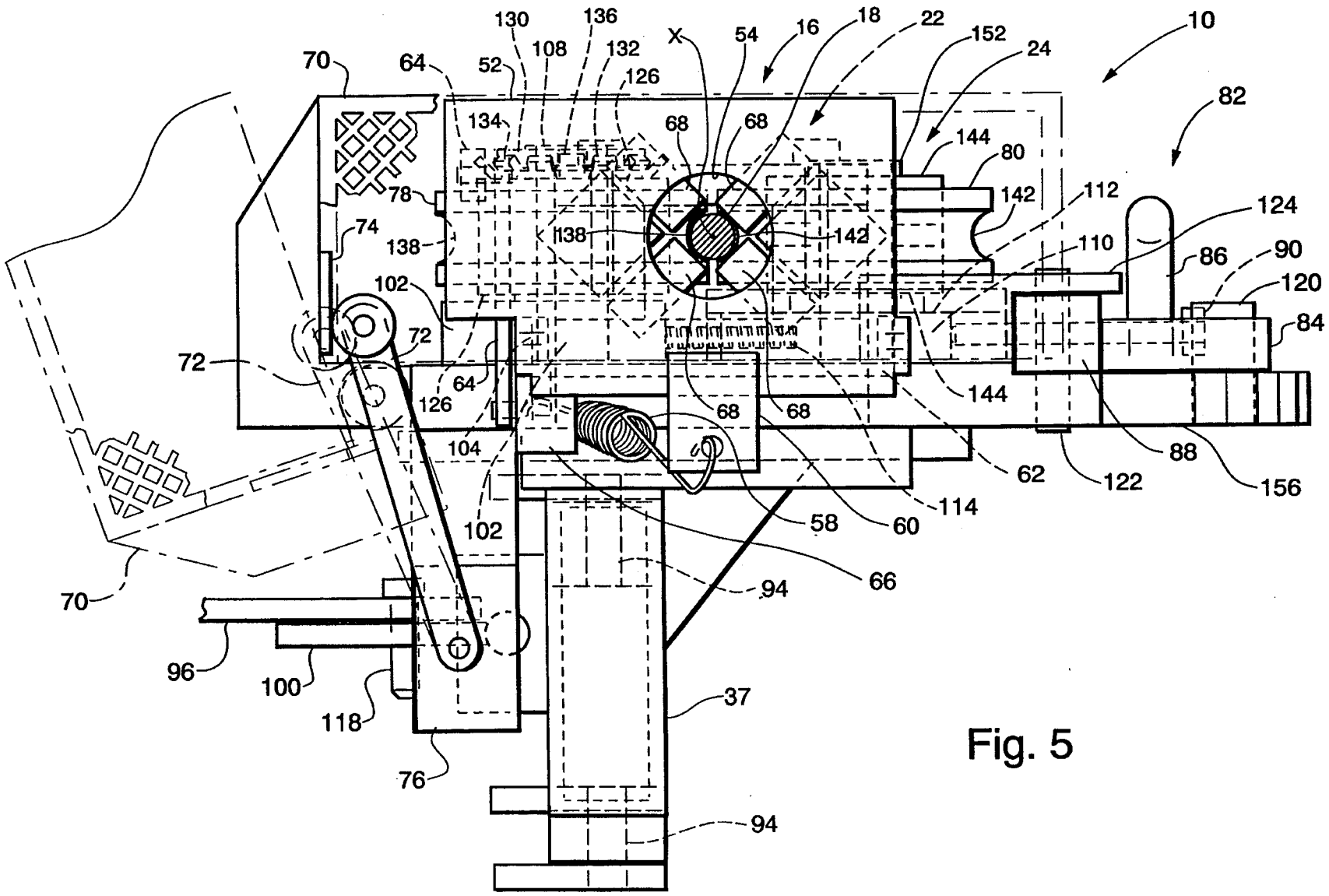
FIG. 5 is an enlarged end elevation of the preferred embodiment single stage two plane coiled reinforcing bar stock straightener as shown in FIG. 4 and seen along the line 5—5 thereof.

The enlarged end elevation view shown in FIG. 5 illustrates the relationship of the various straightener 10 operational components relative to the re-bar coil stock 18 infeed and the re-bar coil stock infeed axis "X". Also shown in FIG. 5 in phantom is pivotal deflection of the safety guard cover 70 for facilitated make-ready access to the infeed axis "X" area for initial set-up adjustment of the infeed axis horizontal adjustment bar 102, with extension operation of the safety guard cover switch tripper 72 in tripping the safety guard cover switch 76 to cut machine 12 powering capability during worker access to the operational components of the straightener 10 during initial make-ready adjustment procedures.

Figure 6:
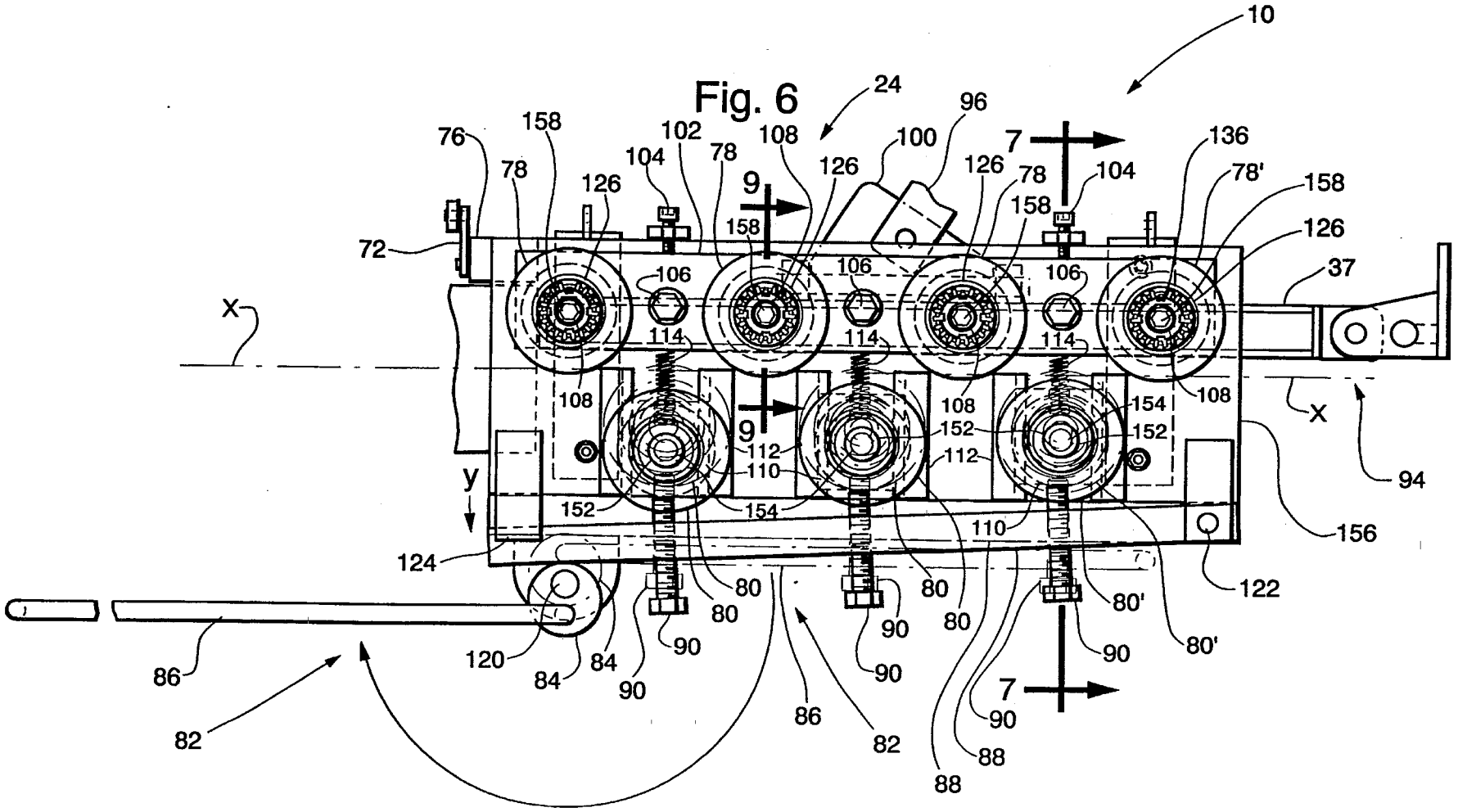
FIG. 6 is a top plan view of the preferred embodiment single stage two plane coiled reinforcing bar stock straightener with the straightening rollers thereof profiled in the open coiled re-bar infeed load position.

Referring now to FIG. 6 which shows employment of the cam operable horizontally adjustable straightening roller opener 82, from the closed phantom line illustration to the open solid line illustration thereof, accomplished by movement of the cam bar 86 pivotally about the cam pintle 120. It will be noted that as the cam 84 is rotated in the manner as illustrated, the slide block compression springs 114 expand pushing the slide blocks 110 outward against the adjustment bolts 90 which are engaged in threadable insertion through the cam bar 86, thus causing the cam bar 86 to outwardly rotate about the cam bar pintle 122 away from the cam bar keeper 124 and against the face of cam 84 as shown by arrow "y", thereby also to move the horizontally adjustable straightening rollers 80 outwards to provide make-ready access for infeed of re-bar coil stock and positioning of the infeed axis horizontal adjustment bar 102 along the infeed axis "X".

Figures 7, 8:
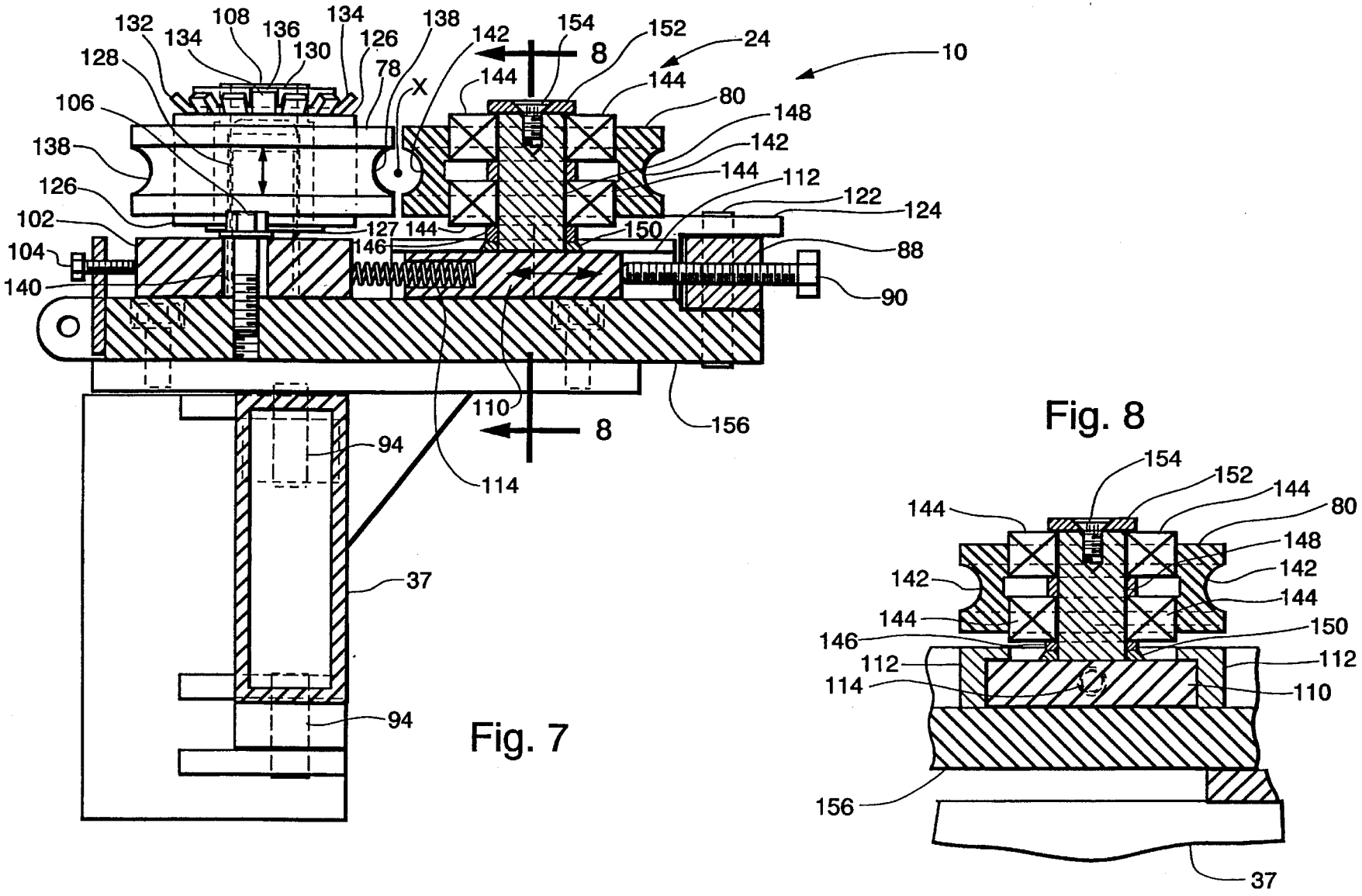
FIG. 7 is an enlarged end sectional view of the straightening roll assemblies as shown in FIG. 6 and seen along the line 7—7 thereof.
FIG. 8 is a side sectional view of a horizontally adjustable straightening roll assembly as shown in FIG. 7 and seen along the line 8—8 thereof.

Considering now the enlarged end sectional view of the straightening roll station 24 as shown in FIG. 7, and directing attention first to the vertically adjustable straightening roller 78. As shown, the roller 78 is press fit assembled to vertical roller bearings 126 which in turn are slidably assembled to rest upon the bearing support lip 127 of the vertically adjustable allen bolt 108. The allen bolt 108 in turn is threadably assembled to the mounting stud 128 which is threadably assembled to and carried by the infeed axis horizontal adjustment bar 102. The entire vertically adjustable straightening roller 78 assembly is held together in vertical adjustment and operational use by a threaded locking collar 130 held and retained in threaded position upon the vertically adjustable allen bolt 108 by a tabbed washer 132 having lock tabs 134 one of which is upwardly bent to engage a lock notch 136 in said threaded locking collar 130. With the roller 78 assembly as above described, then horizontal movement of the infeed axis horizontal adjustment bar 102 is made as was previously described to bring the re-bar coil stock 18 infeed on horizontal alignment with the re-bar coil stock infeed axis "X", and vertical adjustment of the straightening roller 78 elevation threadably upon the mounting stud 128 by means of allen wrench turning of the vertically adjustable allen bolt 108 is employed to effect vertical plane deflection of the vertical roller straightening groove 138 whereby straightening of the re-bar coil stock 18 infeed carried and deformed thereby to infeed axis "X" conformity is achieved in the vertical plane reference.

It will also be noted with respect to horizontal movement of the infeed axis horizontal adjustment bar 102, such movement is in turn against compressive force of the slide block compression spring 114 by means of the adjustment bolts 104 and accommodated within the bar set bolt openings 140. And, as previously recited in accomplishing make-ready procedures, horizontal adjustment of the vertically adjustable straightening rollers 78 is first accomplished to bring the re-bar coil stock 18 infeed into infeed axis "X" coincidence and adjustment range of both the vertically and horizontally adjustable straightening rollers 78 and 80.

Also shown in FIG. 7 is structural detail of the horizontally adjustable straightening roller 80 assembly, which operates to deflect the horizontal roller straightening groove 142 whereby horizontal plane straightening of the re-bar coil stock 18 infeed carried thereby to infeed axis "X" conformity is achieved, being accomplished by means of adjustment bolt 90 movement of the slide block 110 against the resistive force of compression spring 114 as was previously described. It will be noted that the horizontally adjustable straightening rollers 80 are moveable in make-ready adjustment per se in the horizontal direction only, by means of the slide block, spring and bolt assembly as above described.

In assembly, the horizontally adjustable straightening roller 80 as shown in FIG. 7 is press fit to horizontal roller bearings 144 which in turn are slidably assembled to rest upon the bearing support spacer 146 of the horizontal roller support shaft 148 connected by welds 150 to the slide block 110. The roller 80 assembly as above described is retained upon the support shaft 148 by means of a bearing fixer cap 152 and screw 154. The view shown in FIG. 8 is a side sectional illustration of the horizontally adjustable straightening roller 80 assembly as shown in FIG. 7 and seen along the line 7—7 thereof.

Figure 9:
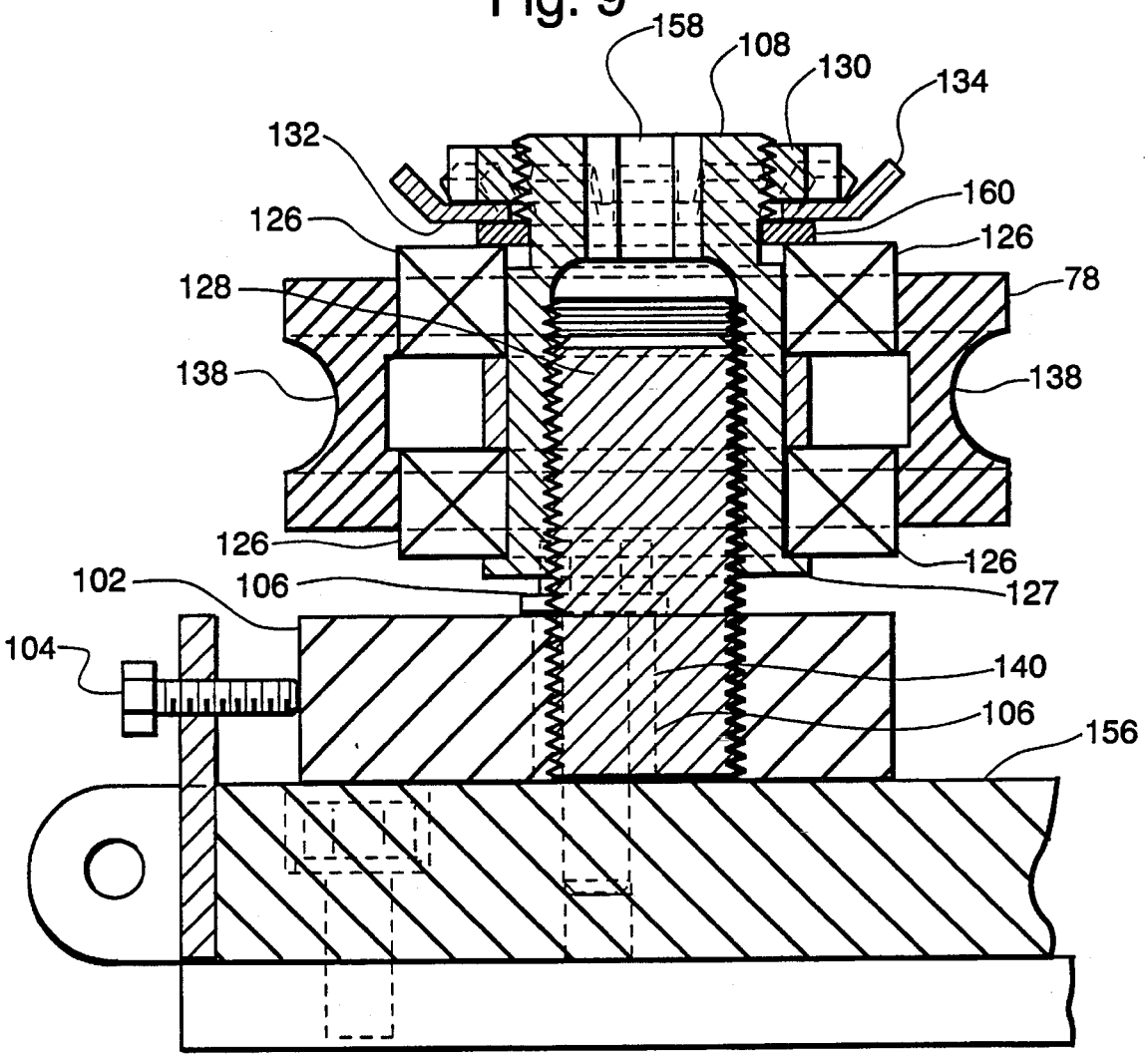
FIG. 9 is an enlarged end sectional view of a vertically adjustable straightening roll assembly as shown in FIG. 6 and seen along the line 9—9 thereof.

Directing attention now to FIG. 9, which is an enlarged sectional view of the vertically adjustable straightening roller 78, showing in greater detail the structural and adjustment features thereof. As was previously related, horizontal movement and stabilized set of the vertically adjustable straightening roller 78 with respect to bringing the re-bar coil stock 18 infeed into a straightened condition coincidental with infeed axis "X" is achieved by means of movement of the infeed axis horizontal adjustment bar 102 through use of the adjustment bolts 104. Once the horizontal adjustment of the vertically adjustable straightening roller 78 is achieved as above described, within the horizontal adjustment latitude as enabled by the bar set opening 140, then the set is further stabilized and secured by means of compressive engagement of the adjustment bar 102 to the base 156 utilizing the bar set bolts 106. Vertical adjustment of the roller 78 is by means of insertion of an allen wrench within the allen bolt hex bore wrench socket 158 and with the wrench, turning the vertically adjustable allen bolt 108 so as to threadably move it either up or down on the mounting stud 128 as is necessary in order to bring the re-bar coil stock 18 infeed into a straightened condition coincidental with infeed axis "X" vertically.

In addition to previously shown structural detail of the vertically adjustable straightening roller 78 assembly, FIG. 9 also shows the upper bearing retaining washer 160 whereby the vertical roller bearings 126 are maintained upon the vertically adjustable allen bolt 108 under adjusted retention by means of the threaded locking collar 130 and tabbed washer 132.

The illustration of FIGS. 10 and 11 respectively show top and side elevation views of the fixed single stage two plane coiled reinforcing bar stock straightener 10A, which is a non-coiled pivotal alternate embodiment version of the previously described pivotal version of the straightener 10, and is characterized as follows. With the exception of being a fixed position infeed straightener, and elimination of the straightened re-bar coil stock infeed compressive guide roll assembly 26 which in the case of a fixed infeed installation of the straightener 10A has not been found to be necessary, all other mechanical and operational features and functions of the fixed straightener 10A are exactly the same, thus a re-description thereof is not deemed necessary.

Installation of the straightener 10A to the machine 12 is by means of a tubular main strut 162 which provides primary support for the straightener 10A, being connected thereto by weldments 164, wherein the tubular main strut 162 is in turn connected to said machine 12 also by means of weldments 164. Further support and angular stabilization of the straightener 10A and main strut 162 is provided by the fixed stabilizing strut 166 angularly connected from said machine 12 by weldments 164 to said main strut 162 as shown.

Figures 10, 11:
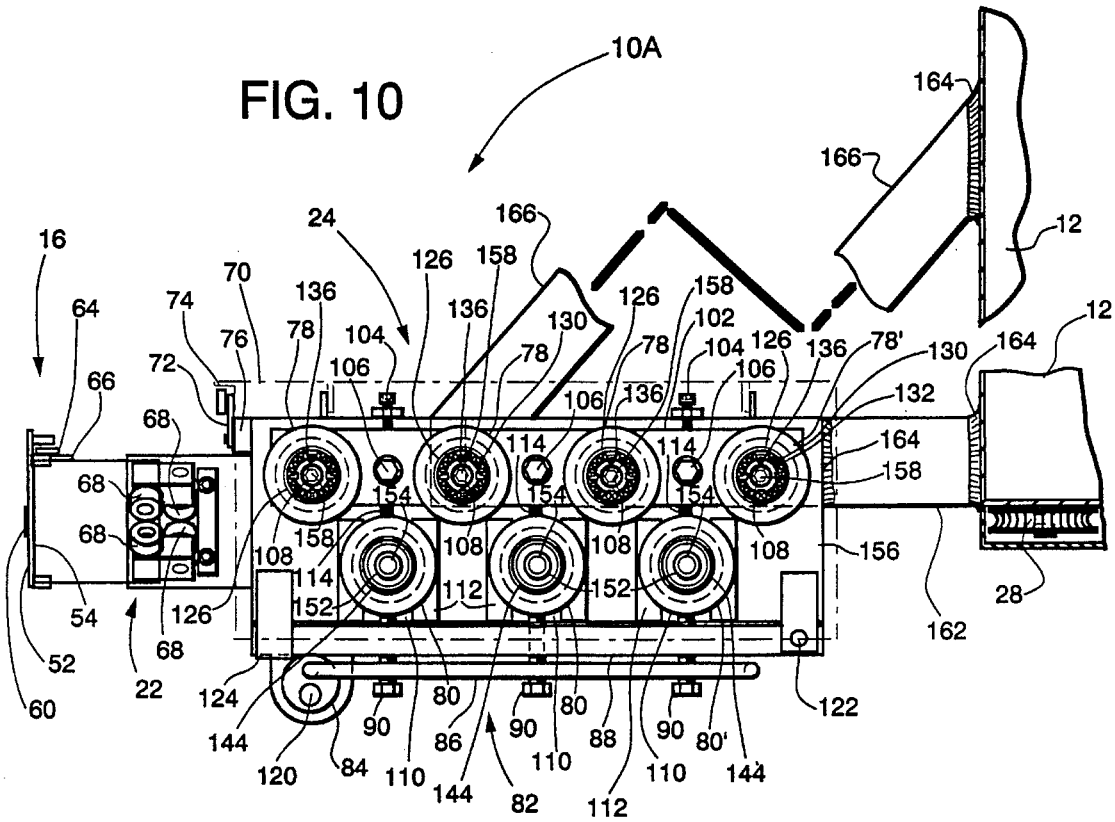
FIGS. 10 and 11 are respectively top and side elevation views of the fixed single stage two plane coiled reinforcing bar stock straightener alternate embodiment of instant invention.

Lastly, with respect to FIGS. 10 and 11, infeed of the straightened re-bar coil stock from the straightener 10A to the compressive drive wheels 28 is directed and conformed to infeed axis "X" alignment by means of the inboard vertical and horizontal straightening rollers 78' and 80', also as was previously detailed and described.

Figure 12:
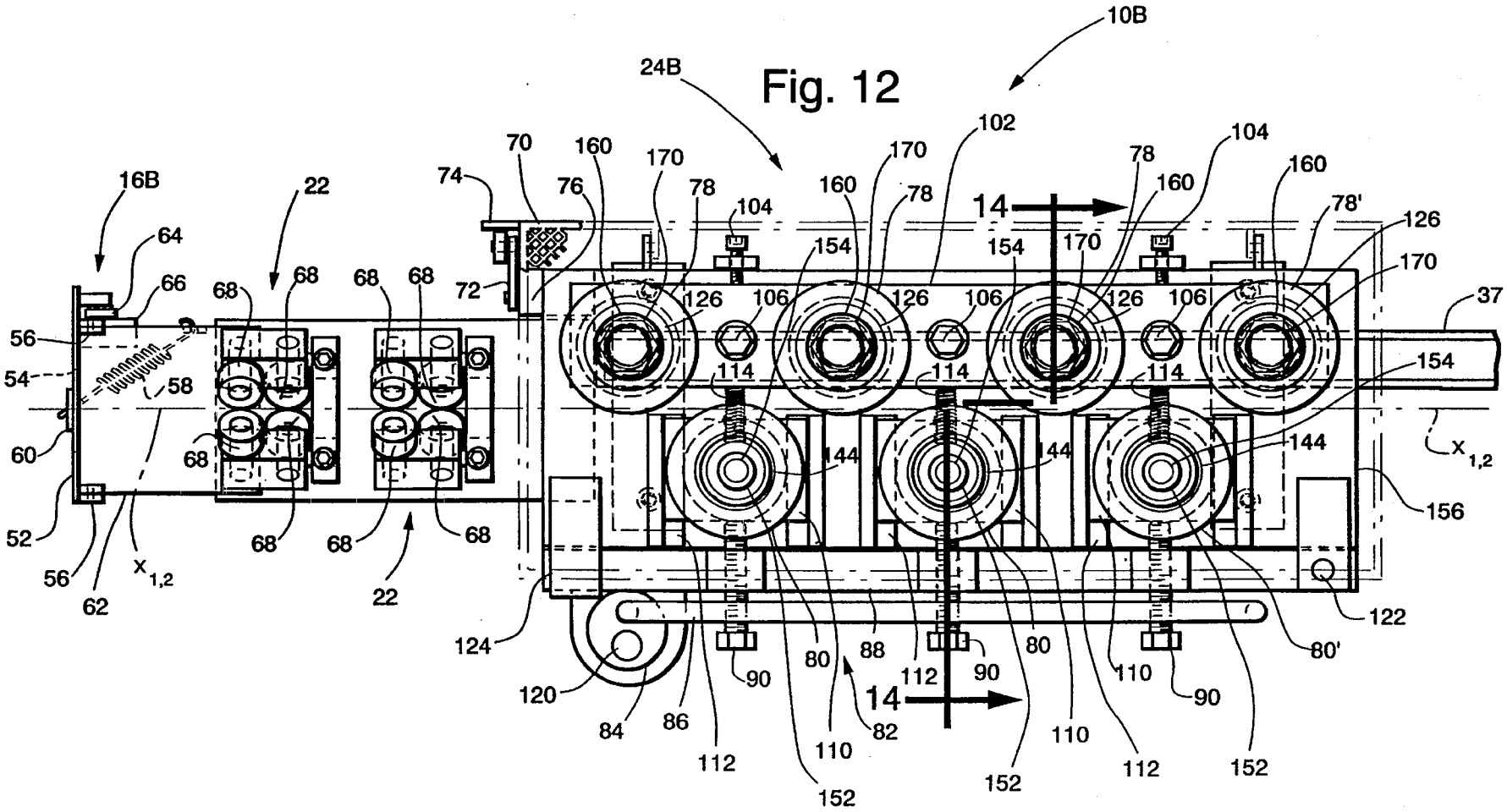
FIG. 12 is a top plan view of the duplex single stage two plane reinforcing bar stock straightener alternate embodiment of instant invention.
Figure 13:
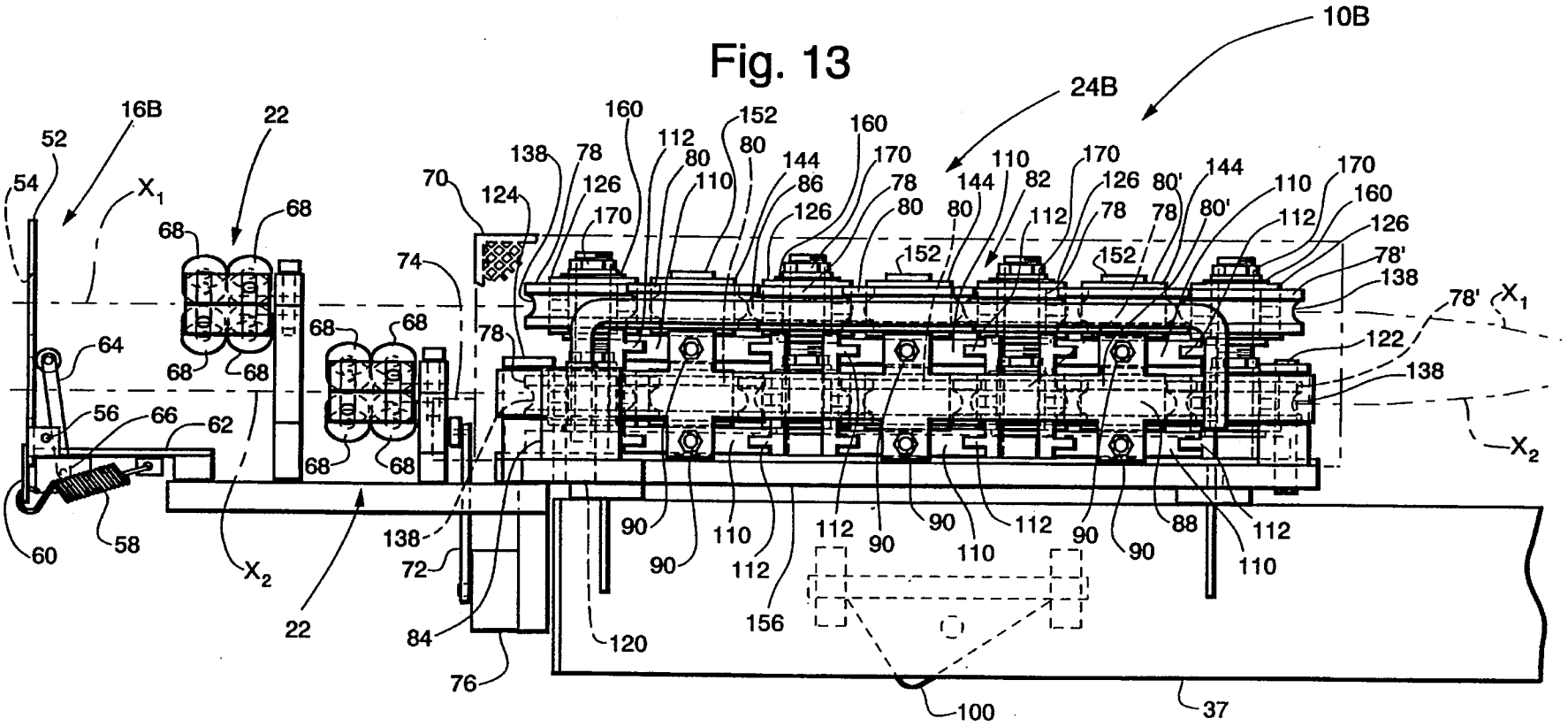
FIG. 13 is a side elevation view of the duplex single stage two plane reinforcing bar stock straightener alternate embodiment as previously shown in FIG. 12.

Turning consideration now to FIGS. 12 and 13, respectively illustrating a top and side elevation view of yet another embodiment of the straightener hereof, being a duplex single stage two plane coiled reinforcing bar stock straightener 10B, which incorporates a stacked set of straighteners with dual vertically offset re-bar coil stock guide roll assemblies 22 and a duplex coil feed jam and safety switch assembly 16B, being operational to simultaneously guide and straighten two infeeds of re-bar coil stock one each along infeed axis "X"1 and the other along infeed axis "X"2 for delivery to a two-up processing stirrup bending machine. Again, with the exception of being a duplex profile, the mechanical and operational features and functions of the duplex straightener 10B are, with minor exception, the same as both the straightener 10 and fixed straightener 10A, wherein the exceptions will be hereafter noted. It should also be noted that the duplex straightener 10B is shown in FIGS. 12 and 13 as being assembled to a pivotal mounting base 37, which is to be regarded as exemplary only since the same could alternately be assembled in a fixed installation connection to a typical stirrup bending machine by means of a tubular main strut with a fixed stabilizing strut as was previously shown for the fixed straightener 10A.

The view shown in FIG. 13 illustrates more clearly the stacked structure of a duplex straightener 10B, with each infeed axis "X"1 and "X"2 being processed by a separate but mechanically cooperative straightening roll station 24B. In the case of a duplex straightener, the inboard vertically and horizontally adjustable straightening rollers 78' and 80', as was the case before, direct the straightened re-bar coil stock infeed from the plurality of vertical and horizontal straightening rollers 78 and 80 into the respective machine loader compressive drive wheels 28, not her shown. Otherwise, the make-ready set-up and mechanical and operational processing functions of the duplex straightener 10B are as was previously detailed and described for the straighteners 10 and 10A.

Figure 14:
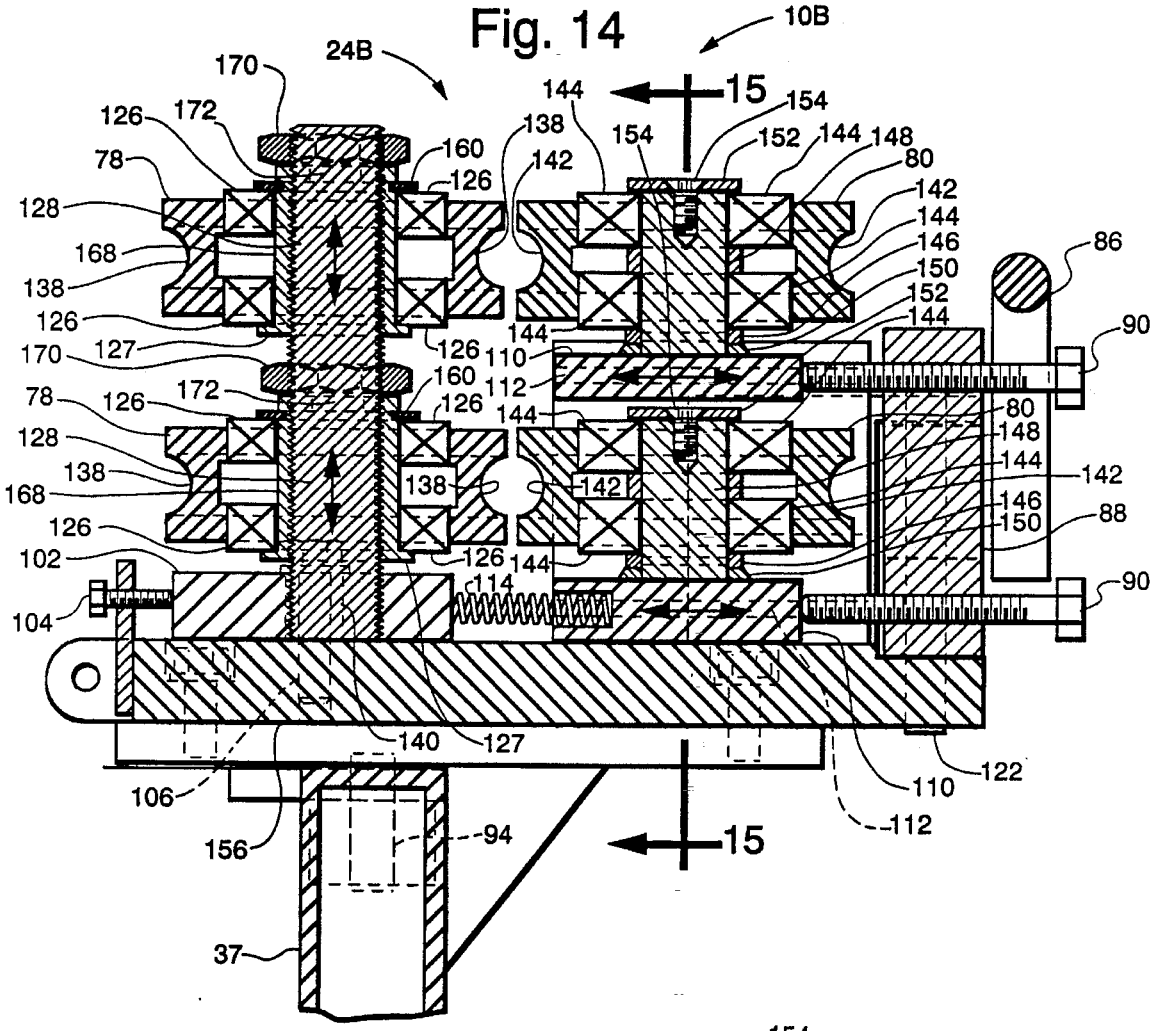
FIG. 14 is an enlarged end sectional view of the dual coil straightening roll assemblies as shown in FIG. 12 and seen along the line 14—14 thereof.
Figure 15:
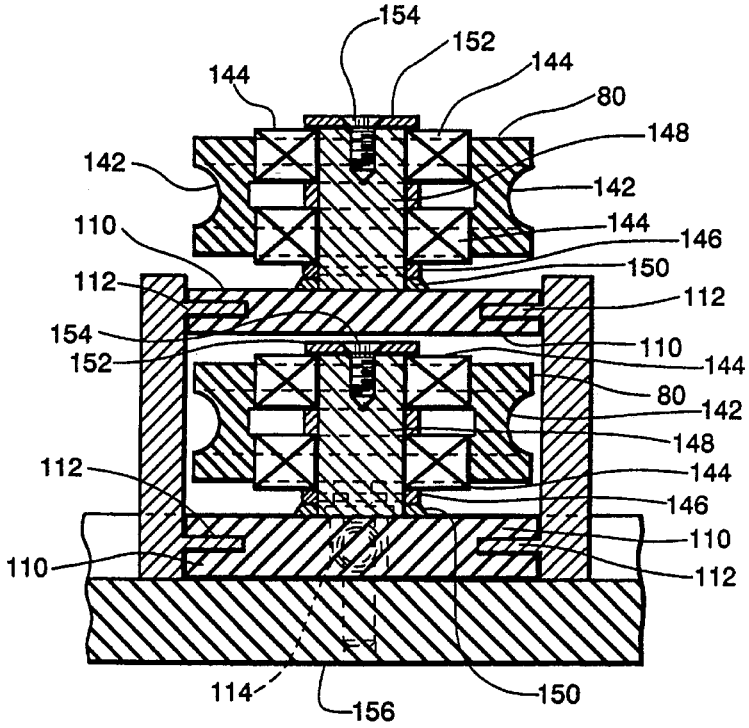
FIG. 15 is a side sectional view of the dual coil horizontally adjustable straightening roll assemblies as shown in FIG. 14 and seen along the line 15—15 thereof.

The enlarged sectional views of the duplex straightener roll assemblies as shown in FIGS. 14 and 15 illustrate the structural detail for accomplishing roller adjustment. In the case of the horizontal rollers 80, horizontal adjustment as was previously described is by means of the lower slide block 110 against the slide block compression spring 114, with the adjusted horizontal set being held and stabilized by adjustment bolts 90.

In the case of the duplex unit vertically adjustable rollers 78, initial horizontal make-ready adjustment is made by means of the infeed axis horizontal adjustment bar 102 and adjustment bolts 104 also against the compression spring 114. Vertical adjustment of the duplex rollers 78 is made threadably upon the mounting stud 128 through rotation of the threaded sleeve 168 by twisting the sleeve with an open end wrench utilizing the sleeve flats 172. Once vertical adjustment of the duplex vertical roller 78 is obtained, then the threaded sleeve 168 is locked for operational rotation in adjusted disposition upon the mounting stud 128 by means of jam nut 170 which is threadably engaged compressively against the upper end of said sleeve 168.

Figure 16:
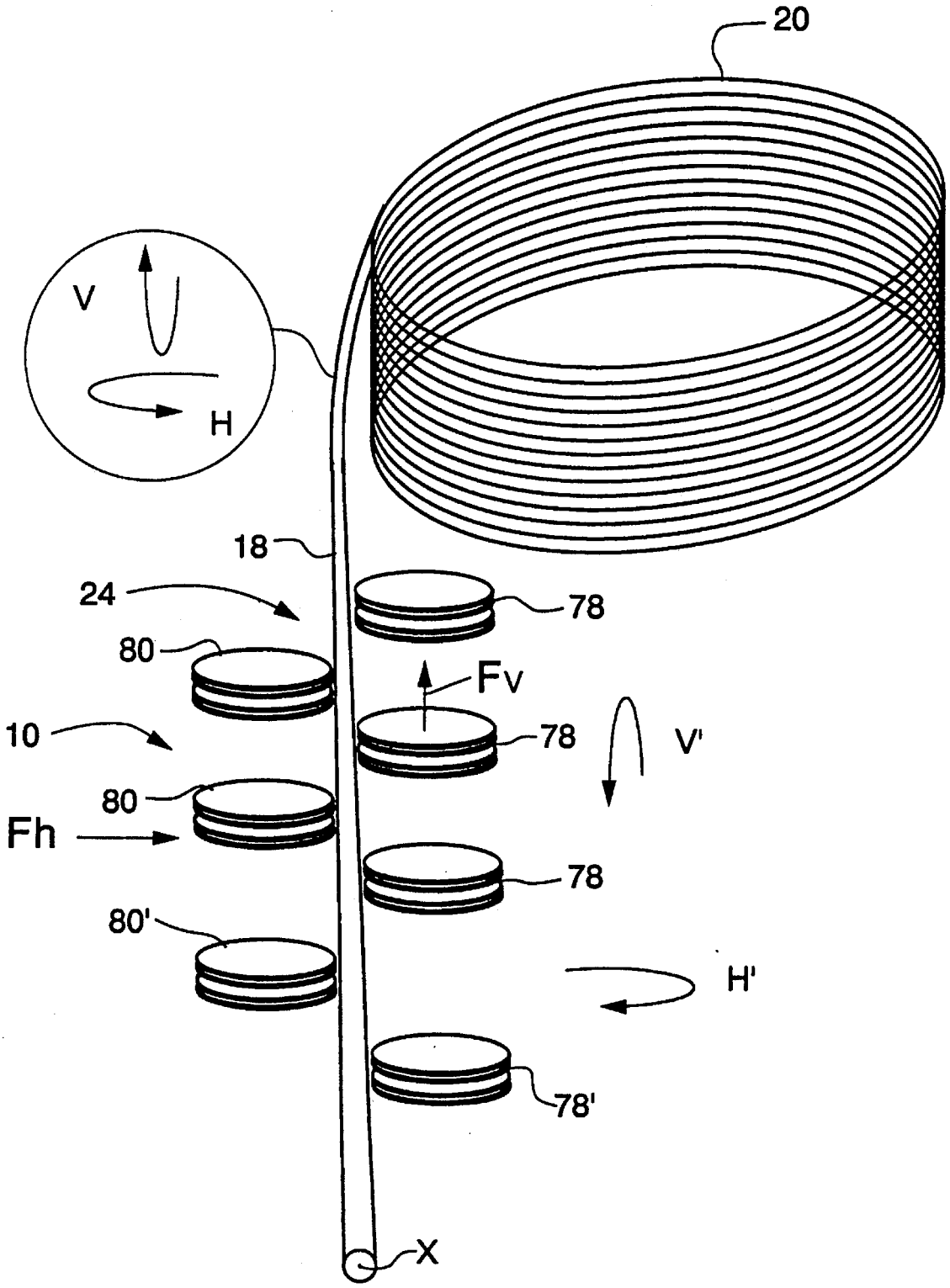
FIG. 16 is a schematic illustration showing the relation of horizontal and vertical coil set profiles to be straightened to the single stage two plane straightening roller adjustment profiles to effect straightening.

Lastly, and in summary, attention is directed to the schematic illustration shown in FIG. 16 which depicts the relation of vertical and horizontal coil set profiles of the re-bar coil stock 18 to be straightened to the vertical and horizontal straightening roller 78 and 80 adjustment profiles necessary to fact straightening. As shown by the V and H arrows associated with the re-bar coil stock 18 feeding into the straightener 10 from the re-bar coil 20, which represents the vertical and horizontal coil set profiles respectively and the relative magnitudes of straightening which is to be accomplished by the straightener 10 in order to thereby bring the re-bar coil stock 18 into coincidence with the infeed axis X as said coil stock 18 is delivered from said straightener 10 as infeed to the compressive drive wheels 28 of the machine 12. In order to accomplish the foregoing straightening it is necessary to employ vertically and horizontally adjustable rollers 78 and 80 in applications of opposing deflective forces on the re-bar coil stock 18 infeed as it traverses the straightening roll station 24. The opposing deflective forces necessary to effect horizontal straightening are applied to the re-bar coil stock 18 infeed by the horizontal straightening rollers 80 against the vertical rollers 78 straightening grooves 138, which function as anvil rollers, in a force magnitude indicated by the arrow Fh to effect a corrective horizontal straightening bend of H'. Similarly, and simultaneously, the opposing deflective forces necessary to effect vertical straightening are applied to the infeeding re-bar coil stock 18 by the vertical straightening rollers 78 against the horizontal rollers 80 straightening grooves 142, which reciprocally function as anvil rollers, in a force magnitude indicated by the arrow Fv to effect a corrective vertical straightening bend of V'. Thus, as the straightened re-bar coil stock 18 emerges from the roll station 24 it has been brought from a state of deformity to straightness in coincidence with infeed axis "X" by the means and method of the single stage two plane coiled reinforcing bar stock straightener 10 hereof.

Although the single stage two plane coiled reinforcing bar stock straightener invention hereof, as well as the structural characteristics and method of employment thereof, respectively have been shown and described in what are conceived to be the most practical and preferred embodiments, it is recognized that departures may be made respectively therefrom within the scope of the invention, which is not to be limited per se to those specific details as disclosed herein but is to be accorded the full scope of the claims so as to embrace any and all equivalent such devices, apparatus, and methods.

We claim:

1. A single stage two plane coiled reinforcing bar stock straightener adapted to effect vertical and horizontal plane coil set straightening of an infeed of re-bar coil stock to a stirrup bending machine, said straightener comprising in combination a re-bar coil stock guide roll assembly adapted to receive and guide an infeed of re-bar coil stock along an infeed axis, a plurality of horizontally set vertically adjustable straightening rollers each respectively having a vertically disposed rotational axis adapted by an infeed axis horizontal adjustment bar to which said plurality of horizontally set vertically adjustable straightening rollers are each respectively assembled in an aligned spaced relationship respectively by means of a threaded mounting stud fixed to the adjustment bar which treaded mounting stud is in turn adapted to threadably receive a vertically adjustable threaded sleeve the vertical axis of which is coincidental with the vertical axis of said threaded mounting stud said threaded sleeve further in turn adapted to receive and moveably support adjustably at least one vertically adjustable straightening roller of said plurality of horizontally set vertically adjustable straightening rollers wherein said infeed axis horizontal adjustment bar is moved and set by means of a spatially aligned plurality of adjustment bolts respectively communicating through an opening in said infeed axis horizontal adjustment bar to horizontally align the same coincidental with said infeed axis, a plurality of horizontally adjustable straightening rollers each respectively having a vertically disposed rotational axis mechanically cooperative with said plurality of vertically adjustable rollers and being respectively adapted by a slide block being moveable by an adjustment bolt against the resistive force of a compression spring, an adjustment means to cooperatively extend and close said plurality of horizontally adjustable straightening rollers coincidental with said infeed axis in effecting said straightening of said re-bar coil stock infeed, and a connection means to align and affix said straightener.

2. A straightener according to claim 1 wherein said plurality of horizontally set vertically adjustable straightening rollers is comprised of a vertically disposed set of such said rollers respectively threadably assembled upon said mounting stud one above the other.

3. A straightener according to claim 1 wherein said plurality of horizontally adjustable straightening rollers is comprised of a vertically disposed set of such said rollers respectively assembled upon said support shaft one above the other.

4. A straightener according to claim 3 wherein said vertically disposed set of said plurality of horizontally adjustable straightening rollers is mechanically cooperative adjustable with said vertically disposed set of said plurality of horizontally set vertically adjustable straightening rollers in effecting separately simultaneous vertical and horizontal plane coil set straightening of a multiple infeed of re-bar coil stock to a multiple infeed processing re-bar coil stock stirrup bending machine.

5. A straightener according to claim 1 wherein said adjustment means is a cam operable horizontally adjustable straightening roller opener.

6. A straightener according to claim 5 wherein said cam operable opener is operable by means of a cam bar.

7. A straightener according to claim 1 wherein said connection means to affix said straightener to said stirrup bender is a pivot assembly.

8. A straightener according to claim 7 wherein said pivot assembly connection means is set to align said straightener to said stirrup bender by means of a detachable stabilizing strut.

9. A straightener according to claim 1 wherein said connection means to affix said straightener to said stirrup bender is a plurality of weldments to a tubular main strut.

10. A straightener according to claim 9 wherein said tubular main strut is set to align said straightener to said stirrup bender by means of a fixed stabilizing strut.

11. A method for effecting vertical and horizontal plane coil set straightening of a vertically and horizontally distorted re-bar coil stock infeed which is effective between a re-bar coil stock feed station and a stirrup bending machine, said method comprising the steps of receivably directing by means of a re-bar coil stock guide roll asssembly an infeed of said re-bar coil stock from said re-bar coil stock feed station along an infeed axis coincidental with that of a straightened re-bar coil stock profile, rotatably engaging concurrently by means of a single stage two plane re-bar coil stock straightener said re-bar coil stock in coincidence with said infeed axis from the opposing sides thereof with a mechanically adjusted plurality of horizontally set vertically adjustable straightening rollers assembled in an aligned spaced relationship and respectively adjustable in the vertical plane being one of the two planes of said single stage two plane re-bar coil stock straightener by means of threadably turning an allen bolt the vertical axis of which is coincidental with the vertical axis of a threaded mounting stud adapted to axially receive and support at least one of said mechanically adjusted plurality of horizontally set vertically adjustable straightening rollers, and a mechanically adjusted cooperative plurality of horizontally adjustable straightening rollers each respectively having a vertically disposed rotational axis and respectively adjustable in the horizontal plane being the other of the two lanes of said single stage two plane re-bar coil stock straightener by means of a slide block assembly in turn operationally extended and cooperatively closed horizontally by a cam operable horizontally adjustable straightening roller opener to thereby simultaneously impart opposing vertical plane and horizontal plane deflective forces on said infed re-bar coil stock of that magnitude sufficient to conform the same from a coil set profile into a profile coincidence with that of said infeed axis prior to infeed delivery thereof to said stirrup bending machine.

* * * * *